US007909082B2

(12) United States Patent
Peoples

(10) Patent No.: US 7,909,082 B2
(45) Date of Patent: Mar. 22, 2011

(54) TWO-COMPONENT SHOWER CURTAIN

(76) Inventor: Douglas Peoples, Norwalk, CT (US)

( * ) Notice: Subject to any disclaimer, the term of this patent is extended or adjusted under 35 U.S.C. 154(b) by 970 days.

(21) Appl. No.: 11/448,936

(22) Filed: Jun. 8, 2006

(65) Prior Publication Data

US 2007/0284058 A1 Dec. 13, 2007

(51) Int. Cl.
*A47K 3/38* (2006.01)

(52) U.S. Cl. ..... 160/123; 160/DIG. 6; 160/DIG. 18

(58) Field of Classification Search ..... 160/123, 160/124, 330, 38, DIG. 6, DIG. 18; 4/558, 4/608

See application file for complete search history.

(56) References Cited

U.S. PATENT DOCUMENTS

| | | | | |
|---|---|---|---|---|
| 2,668,298 | A * | 2/1954 | Kimmons | 4/608 |
| 2,752,993 | A * | 7/1956 | Scott | 160/330 |
| 3,035,275 | A * | 5/1962 | Strebeigh | 4/608 |
| 3,321,003 | A * | 5/1967 | Boerner | 160/237 |
| 5,191,922 | A * | 3/1993 | Wade | 160/124 |
| 5,974,603 | A * | 11/1999 | Frazier | 4/558 |
| 6,192,965 | B1 | 2/2001 | Hinds | |
| 6,394,168 | B1 * | 5/2002 | Zoboski | 160/123 |

* cited by examiner

*Primary Examiner* — David Purol
(74) *Attorney, Agent, or Firm* — Myron Amer P.C.

(57) ABSTRACT

A zippered together shower curtain and valance in which the valance remaining on the shower support rod after the curtain is unzipped for laundering masks the upper zipper track from view and has other attendant benefits.

1 Claim, 1 Drawing Sheet

TWO-COMPONENT SHOWER CURTAIN

The present invention relates generally to improvements for a zippered shower curtain, the improvements more particularly enabling the remaining valance after the unzippering of the shower curtain preparatory to the laundering thereof to have an enhanced appearance.

BACKGROUND OF THE INVENTION

A conveniently cleaned shower curtain, as exemplified by U.S. Pat. No. 6,192,965 for "Zippered Shower Curtain" issued to Charles E. Hinds on Feb. 27, 2001, serves the laundering requirement, but with the tradeoff that the valance remaining on the shower curtain support rod has an undesirable unsightly appearance. Also, in-use, there may be external leakage through the clearance between the upper and lower zipper tracks.

BRIEF SUMMARY OF THE INVENTION

Broadly, it is an object of the present invention to overcome the foregoing and other shortcomings of the prior art.

More particularly, it is an object to structurally reconstitute the valance so that in the zippered and in the unzippered condition of the shower curtain the valance co-acts with the zipper to mask the unsightly appearance of the zipper and concomitantly minimize the adverse consequence of external leakage therethrough.

BRIEF DESCRIPTION OF THE SEVERAL VIEWS OF THE DRAWING

The description of the invention which follows, together with the accompanying drawing should not be construed as limiting the invention to the example shown and described, because those skilled in the art to which this invention appertains will be able to devise other forms thereof.

DETAILED DESCRIPTION OF THE INVENTION

Figure 2:
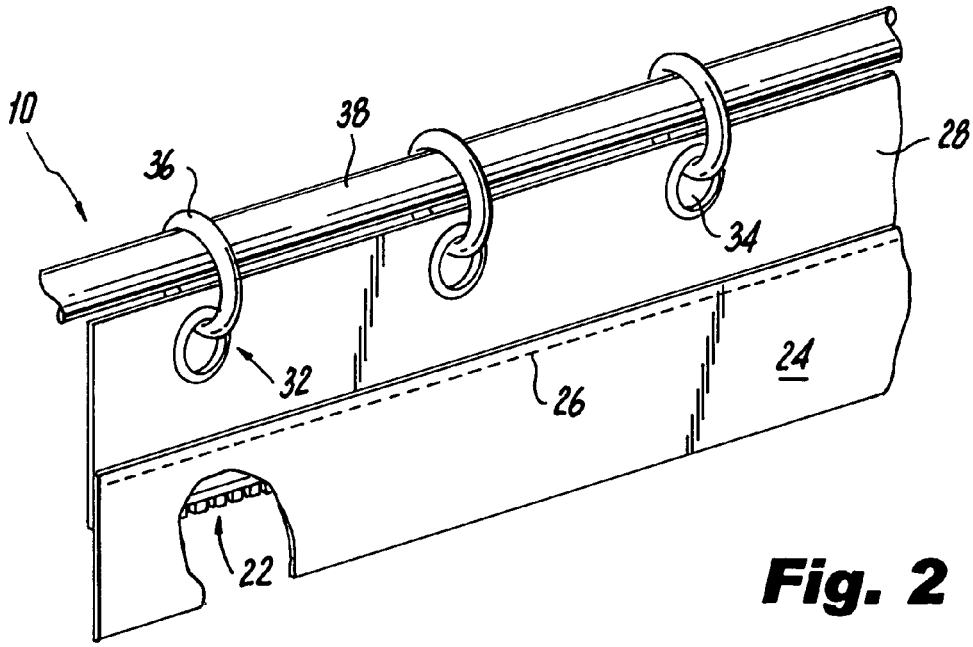
FIG. 2 is a similar view, but only of the valance component of the curtain.

Generally designated 10 is a two-component shower curtain of plastic construction material, in the lower component thereof, namely the curtain 12 per se, the upper edge of which is finished with a lower zipper track 14 (exposed by the folded over side edge 16, as noted at 18) which interconnects at 20 with an upper zipper track 22 which, as best understood from FIG. 2, is masked from view beneath a rectangular shaped and horizontally oriented depending elongated strip 24 sewn at a selected location 26 to a constituted generally designated upper valance component 28 of the article of manufacture 10.

The selected location 26 is, in a preferred embodiment, approximately 1¾ inches below the top edge 30 of the valance 28 so that the bottom edge of strip 24 is in an overlapping relation over the zipper track 22 to mask this zipper track from view. Also, when the curtain is not unzippered, the strip 20 due to its zipper-overlying position, also minimizes any adverse consequence of a direct direction showerhead spray that leaks through the clearance between the teeth of the zipper tracks 22, 14 from continuing as a spray into the shower room.

Figure 1:
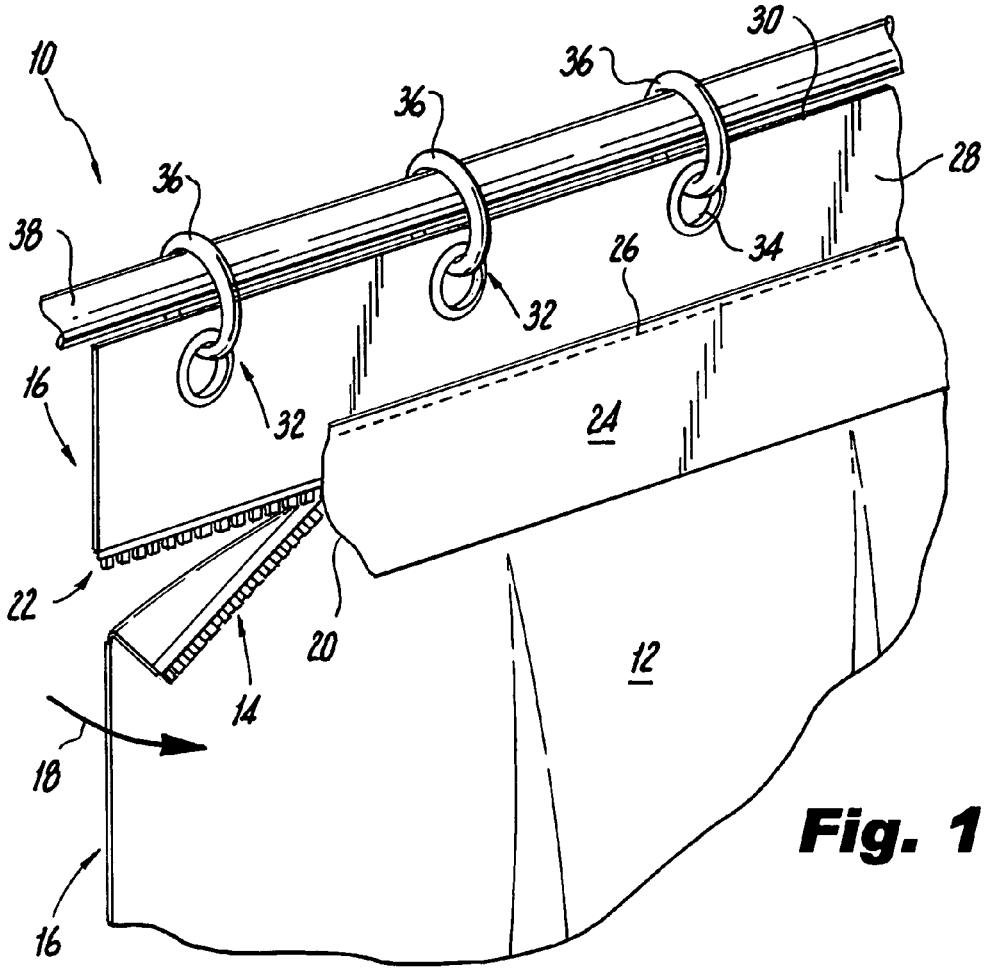
FIG. 1 is a partial front elevational view of a two-component shower curtain according to the present invention.

In its end use depicted in FIG. 1, the upper valance edge 30 is embodied with spaced-apart edge-reinforced or otherwise finished edges 32 bounding openings 34 having in each a cooperating slidably disposed grommet 36 engaged about a support rod 38.

When the shower curtain 12 is unzipped so it can be laundered, as already noted, the remaining upper component of the valance 28 still on the rod 38 is in covering relation over the upper zipper track 22 and masks the same from view.

While the two-component shower curtain herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A two-component shower curtain of a type in an in-use condition suspended from a shower support rod and in a laundering condition disconnected from said support rod, said one-component comprising:

A. a shower curtain of plastic construction material constituted as a. a rectangular shape having an upper edge and a bottom edge;

b. a zipper lower track in sewn attachment along said shower curtain upper edge;

and said second-component comprising:

B. a valance of plastic construction material constituted as c. an elongated first rectangular strip having an upper edge and a bottom edge;

d. plural adjacent spaced apart edges bounding openings in said upper edge for receiving therein grommets for attachment to said support rod;

e. a zipper upper track in sewn attachment along said valance lower edge;

f. an elongated second rectangular strip in sewn attachment at a selected location between said upper and bottom edges; and g. said selected location of said sewn attachment positioning said second rectangular strip in a depending overlapping relation over said zipper upper track;

whereby when said shower curtain is unzippered from said support rod into said laundering condition thereof, said valance remains to mask said zipper upper track from view to contribute to an enhanced shower curtain appearance.

* * * * *